US008870480B2

(12) United States Patent
Yeo et al.

(10) Patent No.: US 8,870,480 B2
(45) Date of Patent: Oct. 28, 2014

(54) ROLL-TO-ROLL PRINTING SYSTEM

(75) Inventors: Kyeong-Min Yeo, Hwaseong-si (KR); Sung Gun Lee, Seongnam-si (KR); Sin Kwon, Suwon-si (KR); Jung Woo Cho, Hwaseong-si (KR); Nam Hoon Lee, Ansan-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 168 days.

(21) Appl. No.: 13/572,353

(22) Filed: Aug. 10, 2012

(65) Prior Publication Data

US 2013/0042774 A1 Feb. 21, 2013

(30) Foreign Application Priority Data

Aug. 16, 2011 (KR) ..... 10-2011-0081369

(51) Int. Cl.
*B41J 15/00* (2006.01)
*B41F 5/00* (2006.01)

(52) U.S. Cl.
CPC ..... *B41F 5/00* (2013.01)
USPC ..... 400/618; 400/583; 400/617; 400/636; 226/174; 226/180; 226/181

(58) Field of Classification Search
USPC ..... 101/219
See application file for complete search history.

(56) References Cited

U.S. PATENT DOCUMENTS

| | | | | |
|---|---|---|---|---|
| 3,586,229 | A * | 6/1971 | Kamada et al. | 226/180 |
| 4,913,330 | A * | 4/1990 | Takahashi | 226/88 |
| 5,651,488 | A * | 7/1997 | Goretzky | 226/190 |
| 6,170,727 | B1 * | 1/2001 | Hevenor et al. | 226/21 |
| 6,412,992 | B2 * | 7/2002 | Mogi | 400/579 |
| 7,395,025 | B2 * | 7/2008 | Matsuzuki et al. | 400/578 |
| 2009/0136281 | A1 * | 5/2009 | Fernandez et al. | 400/618 |
| 2010/0054826 | A1 | 3/2010 | Hieda | |

* cited by examiner

*Primary Examiner* — Jill Culler
(74) *Attorney, Agent, or Firm* — F. Chau & Associates, LLC

(57) ABSTRACT

A roll-to-roll printing system includes driven rolls to apply a feeding force to a flexible substrate so that the flexible substrate is fed from an unwinder to a rewinder, nip rolls respectively disposed above two opposite end portions of each of the driven rolls to pressurize two opposite side portions of the flexible substrate, nip roll driving motors connected to the nip rolls to rotate the nip rolls, and a control unit to receive information regarding change of torque values of the nip roll driving motors and control tension of the flexible substrate based on the information.

17 Claims, 7 Drawing Sheets

ROLL-TO-ROLL PRINTING SYSTEM

CROSS-REFERENCE TO RELATED APPLICATION

This application claims the benefit of Korean Patent Application No. 2011-0081369, filed on Aug. 16, 2011 in the Korean Intellectual Property Office, the disclosure of which is herein incorporated by reference.

TECHNICAL FIELD

Embodiments of the present invention relate to a roll-to-roll printing system for manufacturing electronic circuits, solar cells, electronic books, flexible displays and the like by a roll-to-roll (R2R) method using electronic ink or metal ink.

DISCUSSION OF THE RELATED ART

Various electronic components, such as electronic circuits, sensors, solar cells, flexible displays, radio-frequency identification (RFID) devices and the like, can be more easily manufactured by a process called "printed electronics". Compared with a photolithography process, printed electronics can simplify manufacturing processes, reduce manufacturing time and cost, and achieve massive production at low cost. Since materials other than glass, such as plastic, fibers or paper, can be used to manufacture a substrate, printed electronics has a broad range of applications.

Bendable or flexible substrates for various electronic devices may be produced using roll-to-roll and flexible substrate-related technology. The flexible substrate mentioned herein may be called a web which refers to a substrate having a relatively small thickness and large width and continuity in a longitudinal direction (feeding direction), such as plastic films or steel sheets. The existing lithography processes may be replaced, for realizing lower-cost products, e.g., in the display industry, by various printing processes, such as inkjet, offset printing, relief printing, screen printing, lithographic printing, intaglio printing and the like.

A series of processes including feeding, processing, printing, and storage processes may be continuously performed by a roll-to-roll system that includes an unwinder to unwind a substrate, a rewinder to rewind the unwound substrate, driven rolls to feed the substrate, and idle rolls to guide the substrate.

The roll-to-roll system may perform high-level tension control for enhancing product quality. Several tension control methods may be adopted by the roll-to-roll system. Among them, a direct tension control method measures a tension of a substrate within a span using a load cell, inputs an error value or difference from a reference tension to a proportional-integral-derivative (PID) controller, and controls speeds of driven rolls. An indirect tension control method measures a displacement of a dancer, inputs an error value or difference from a reference dancer position to a PID controller, and controls speeds of driven rolls.

When measuring the tension of the flexible substrate using the load cell, the flexible substrate is wound around over a certain length area of a tension measuring roll mounted with the load cell. When measuring the tension of the flexible substrate using the dancer, the flexible substrate is fed while wound around the dancer and the driven rolls. In other words, the flexible substrate is wound around the rolls and thus bent in the tension control methods using the load cell and the dancer. When the flexible substrate spread with a fluid having a low viscosity, such as liquid crystal, is fed by the roll-to-roll system, if the tension of the flexible substrate is controlled by the tension control method using the load cell or the dancer, the fluid spread on the flexible substrate may run down while the flexible substrate is wound and bent around the rolls, which results in a deterioration of product quality.

Also, when the flexible substrate is fed by the roll-to-roll system, the nipping operation is performed on the flexible substrate to apply a feeding force to the flexible substrate. The nipping operation enables the flexible substrate to be tightly interposed between nip rolls and driving rolls by pressurizing the flexible substrate using the nip rolls. When the flexible substrate spread with the low-viscosity fluid, such as liquid crystal, is fed by the roll-to-roll system, a process layer formed by spreading the fluid onto the flexible substrate may be damaged while the flexible substrate is pressurized by the nip rolls, which results in a deterioration of product quality.

SUMMARY

An embodiment of the present invention provides a roll-to-roll printing system adopting a flexible substrate tension control method using torque values of nip roll driving motors instead of using a load cell or a dancer, thereby feeding the flexible substrate without a flow of a low-viscosity fluid, such as liquid crystal, after spreading the fluid onto the flexible substrate.

An embodiment of the present invention provides a roll-to-roll printing system designed for nipping specified portions of the flexible substrate, thereby feeding the flexible substrate without damaging a process layer formed by spreading the low-viscosity fluid, such as liquid crystal, onto the flexible substrate.

An embodiment of the present invention provides a roll-to-roll printing system configured to use torque values of nip roll unit driving motors as well as torque values of the nip roll driving motors to control a tension of the flexible substrate, thereby controlling the tension of the flexible substrate in both a machine direction and a cross machine direction.

In accordance with an embodiment of the present invention, a roll-to-roll printing system includes driven rolls to apply a feeding force to a flexible substrate so that the flexible substrate is fed from an unwinder to rewinder, nip rolls respectively disposed above two opposite end portions of each of the driven rolls to pressurize two opposite side portions of the flexible substrate, nip roll driving motors connected to the nip rolls to rotate the nip rolls, and a control unit to receive information regarding change of torque values of the nip roll driving motors and control a tension of the flexible substrate based on the information.

The roll-to-roll printing system may further include driven roll driving motors connected to the driven rolls to rotate the driven rolls.

The control unit may be configured to enable an operation of the driven roll driving motors to be synchronized with an operation of the nip roll driving motors.

Also, the control unit may be configured to control the tension of the flexible substrate in a machine direction based on the information.

When the torque values of the nip roll driving motors increase, the control unit may enable speeds of the driven roll driving motors and of the nip roll driving motors to increase.

Also, when the torque values of the nip roll driving motors decrease, the control unit may enable speeds of the driven roll driving motors and of the nip roll driving motors to decrease.

The roll-to-roll printing system may further include nip roll units including the nip rolls and pressurizing cylinders to pressurize the nip rolls, and nip roll unit driving motors connected to the nip roll units to spin the nip roll units.

The control unit may be configured to control the tension of the flexible substrate in a cross machine direction based on information regarding a change of torque values of the nip roll unit driving motors.

When the torque values of the nip roll unit driving motors increase, the control unit may control the nip roll unit driving motors so that the nip rolls spin in an inward direction of the flexible substrate.

Also, when the torque values of the nip roll unit driving motors decrease, the control unit may control the nip roll unit driving motors so that the nip rolls spin in an outward direction of the flexible substrate.

The roll-to-roll printing system may further include a dispenser to perform a printing process by spreading fluid having a certain viscosity onto the flexible substrate.

Also, the roll-to-roll printing system may further include air lifting devices to lift the flexible substrate by applying air pressure to the flexible substrate.

The nip rolls may be made of urethane or polydimethylsiloxane.

BRIEF DESCRIPTION OF THE DRAWINGS

The embodiments of the invention will become apparent and more readily appreciated from the following description taken in conjunction with the accompanying drawings of which.

DETAILED DESCRIPTION

Figure 1:
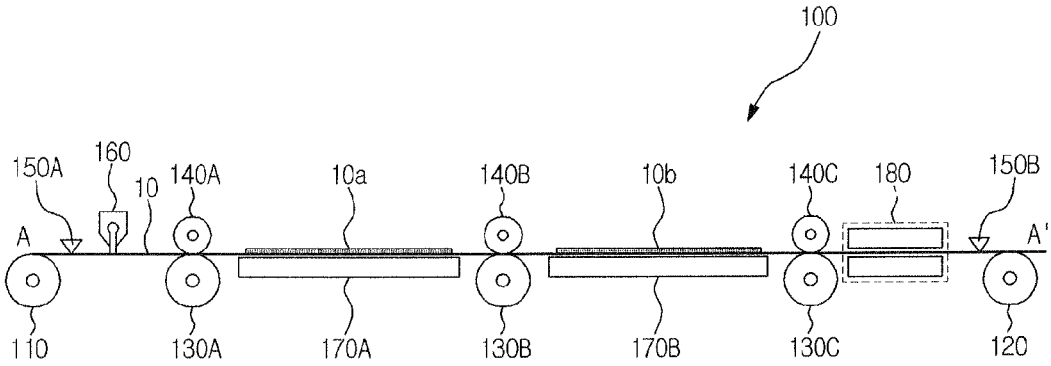
FIG. 1 is a view showing a configuration of a roll-to-roll printing system according to an embodiment of the present invention.

Reference will now be made in detail to the embodiments of the present invention, examples of which are illustrated in the accompanying drawings, wherein like reference numerals may refer to like or similar elements throughout the specification and the drawings. The present invention may be embodied in various different ways and should not be construed as limited to the exemplary embodiments described herein.

It will be understood that when an element or layer is referred to as being "on," "connected to" or "coupled to" another element or layer, it can be directly on, connected or coupled to the other element or layer or intervening elements or layers may be present.

As used herein, the singular forms, "a," "an" and "the" are intended to include the plural forms as well, unless the context clearly indicates otherwise.

Figure 2:
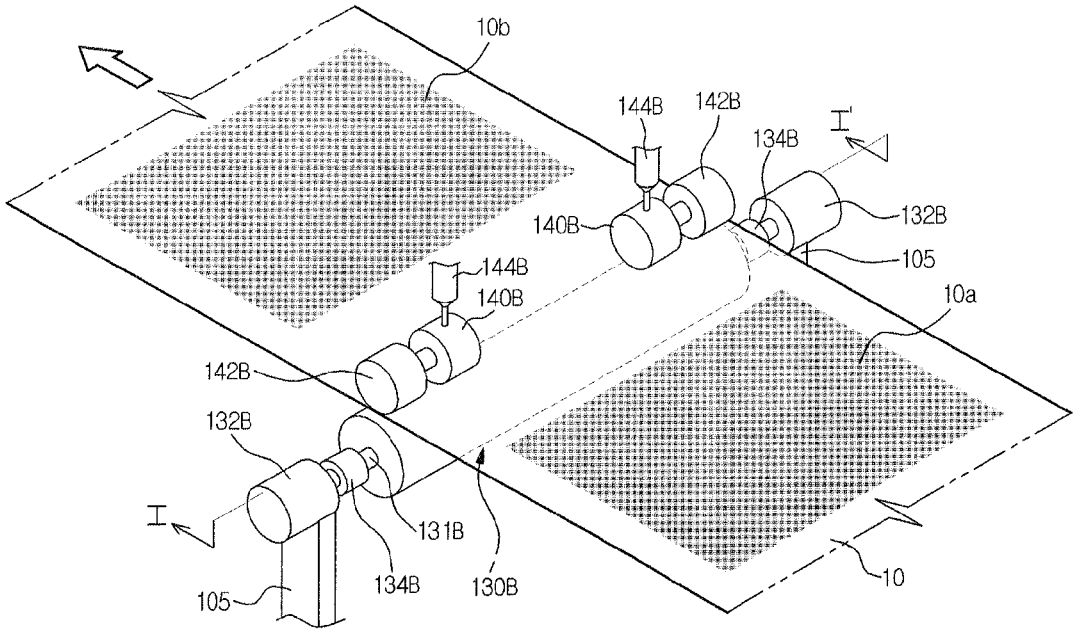
FIG. 2 is a perspective view showing a nipping operation of nip rolls performed on a flexible substrate in a roll-to-roll printing system according to an embodiment of the present invention.
Figure 3:
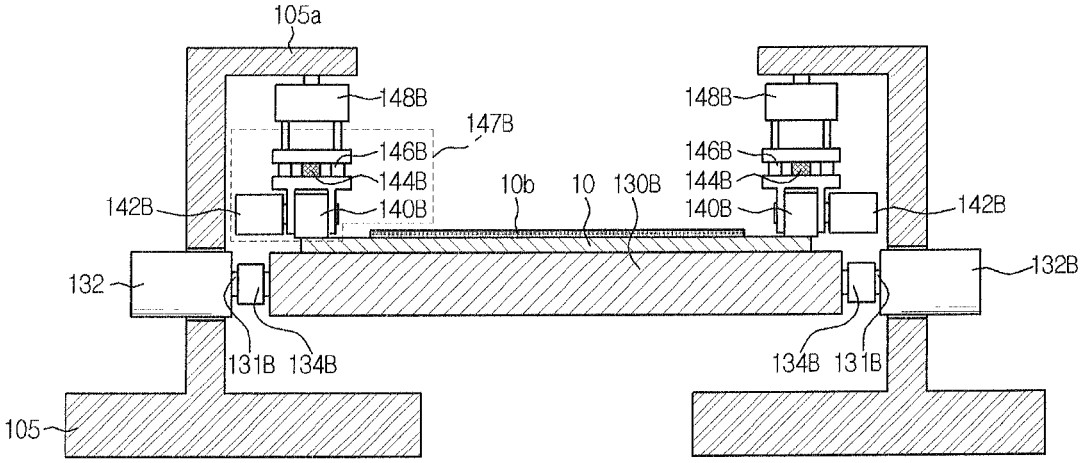
FIG. 3 is a longitudinal sectional view taken along line I-I' in FIG. 2.
Figure 4:
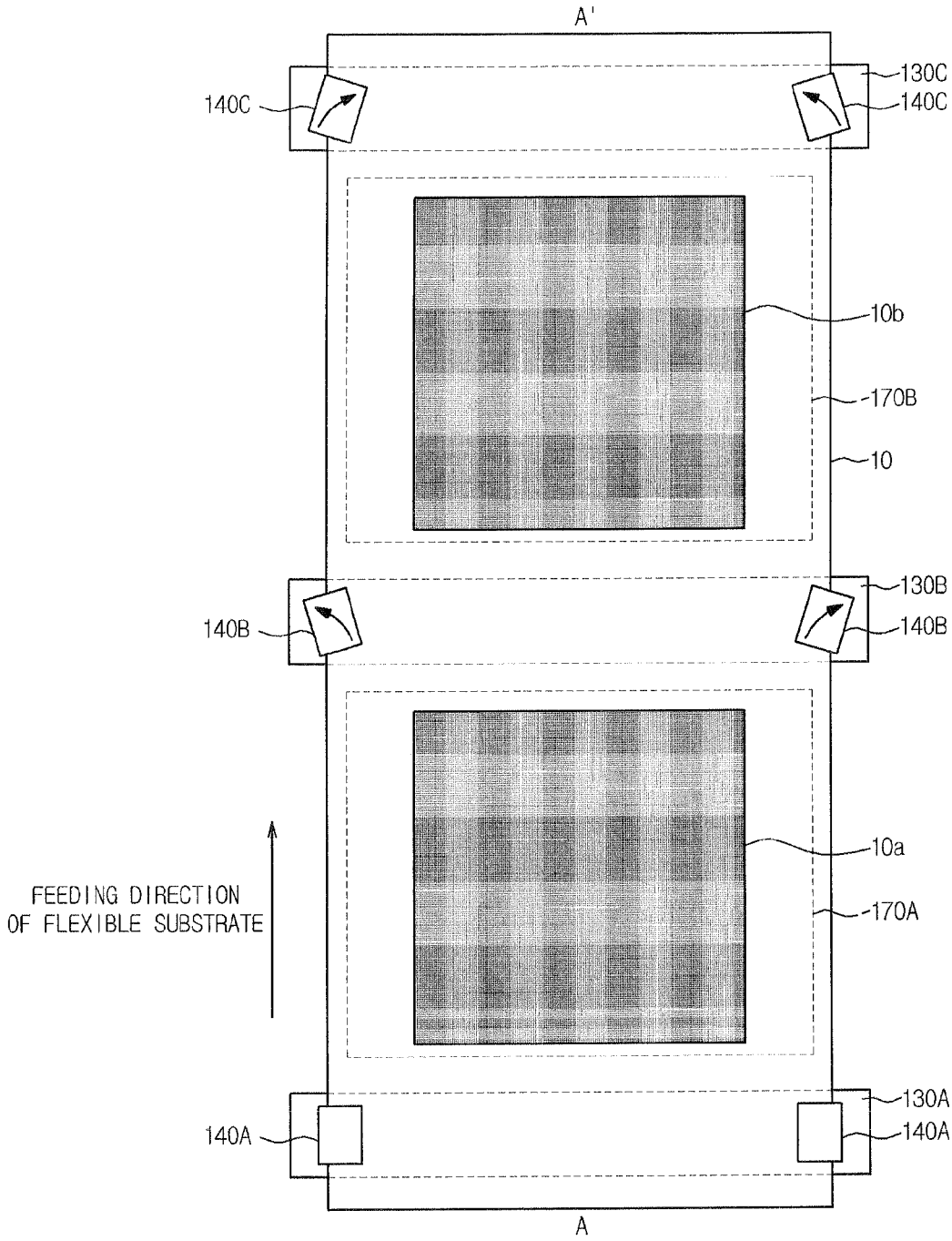
FIG. 4 is a plan view showing a structure for feeding a flexible substrate in a roll-to-roll printing system according to an embodiment of the present invention.
Figure 5:
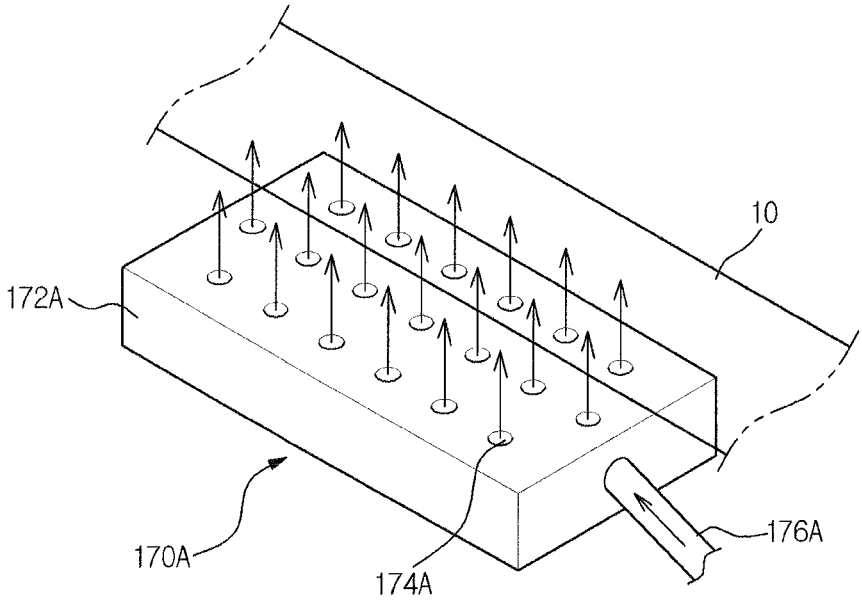
FIG. 5 is a perspective view showing an air lifting device of a roll-to-roll printing system according to an embodiment of the present invention.

FIG. 1 is a view showing a configuration of a roll-to-roll printing system according to an embodiment of the present invention, FIG. 2 is a perspective view showing a nipping operation of nip rolls applied to a flexible substrate in a roll-to-roll printing system according to an embodiment of the present invention, FIG. 3 is a longitudinal sectional view taken along line I-I' in FIG. 2, FIG. 4 is a plan view showing a structure for feeding a flexible substrate in a roll-to-roll printing system according to an embodiment of the present invention, and FIG. 5 is a perspective view showing an air lifting device of a roll-to-roll printing system according to an embodiment of the present invention.

As shown in FIG. 1, a roll-to-roll printing system 100 according to an embodiment of the present invention includes an unwinder 110 to unwind a flexible substrate (web) 10 and to feed the unwound flexible substrate to a section for a printing process, a rewinder 120 to rewind the flexible substrate 10 that has undergone the printing process, first, second and third driven rolls 130A, 130B and 130C to carry the flexible substrate 10 by applying a feeding force to the flexible substrate, and first, second and third nip rolls 140A, 140B and 140C to carry the flexible substrate 10 cooperatively with the first, second and third driven rolls 130A, 130B and 130C by pressurizing the flexible substrate 10.

The roll-to-roll printing system 100 further includes first and second edge positioning control (EPC) sensors 150A and 150B to control edge positions of the flexible substrate 10 in a cross direction with respect to a feeding direction (direction A-A' in FIG. 1) of the flexible substrate 10. The first EPC sensor 150A is disposed at a position downstream of the unwinder 110 and controls the edge positions of the flexible substrate 10 fed from the unwinder 110. The second EPC sensor 150B is disposed at a position upstream of the rewinder 120 and controls the edge positions of the flexible substrate 10 fed to the rewinder 120.

Between the first EPC sensor 150A and the first driven roll 130A is provided a dispenser 160 which performs a printing process by spreading a fluid having a certain viscosity, such as liquid crystal, onto the flexible substrate 10. The dispenser 160 does not spread fluid onto an overall surface of the flexible substrate 10 in a transverse direction of the flexible substrate 10. For example, of the surface of the flexible substrate 10, two opposite side margins in the transverse direction of the flexible substrate 10 are not spread with the fluid, and the two opposite side margins are cut out in a final process. As shown in FIG. 2 and FIG. 4, by spreading the fluid onto the flexible substrate 10 using the dispenser 160, process layers 10*a* and 10*b* having a rectangular or square shape are formed on the flexible substrate 10. Each of the process layers 10*a* and 10*b* has two opposite side margins in a transverse direction of the flexible substrate 10.

A nipping operation of the nip rolls 140A, 140B and 140C performed on the flexible substrate 10 may damage the process layers 10*a* and 10*b* of the flexible substrate 10. To prevent such damage, as shown in FIG. 2, two nip rolls 140B are respectively provided above two opposite end portions of the driven roll 130B. For example, one of the two nip rolls 140B is disposed above a left end portion of the driven roll 130B, and the other is disposed above a right end portion of the driven roll 130B. Accordingly, the nip rolls 140B nip only two opposite side margins but not the process layers 10*a* and 10*b* of the flexible substrate 10, thereby feeding the flexible substrate 10 without damaging the process layers 10*a* and 10*b* after the fluid spreading process. According to an embodiment, the nip rolls 140B are made of an elastic material, such as urethane, polydimethylsiloxane (PDMS) or the like, which increases gripping force of the nip rolls 140B applied to the flexible substrate 10.

As shown in FIG. 2 and FIG. 3, rotating shafts 131B are formed on two opposite ends of the driven roll 130B. The rotating shafts 131B are connected to driven roll driving motors 132B through bearings 134B. The driven roll driving motors 132B are supported by support rods 105. The nip rolls 140B, which are respectively disposed above the left and right end portions of the driven roll 130B, are connected with nip roll driving motors 142B for rotating the nip rolls 140B. Since an operation of the driven roll driving motors 132B is synchronized with an operation of the nip roll driving motors 142B, the driven roll 130B and the nip rolls 140B rotate cooperatively with each other, thereby applying a feeding force to the flexible substrate 10 interposed therebetween and feeding the same.

Above the nip rolls 140B are mounted pressurizing cylinders 144B and pressure sensors 146B. The pressurizing cylinders 144B are configured to pressurize the nip rolls 140B so that the nip rolls 140B can pressurize the flexible substrate 10 by a uniform force. The pressure sensors 146B are configured to detect a pressurizing force of the pressurizing cylinders 144B. Nip roll units 147B, each of which includes the nip roll 140B, the nip roll driving motor 142B, the pressurizing cylinder 144B and the pressure sensor 146B, are spun by nip roll unit driving motors 148B. The nip roll unit driving motors 148B are supported by upper support rods 105*a*.

When the roll-to-roll printing system feeds the flexible substrate on which a low-viscosity fluid, such as liquid crystal, is spread, if a tension of the flexible substrate is controlled by a load cell or a dancer, the fluid spread on the flexible substrate may run down while the flexible substrate is wound and bent around the rolls, which results in a deterioration of product quality.

To prevent the fluid from running down, the roll-to-roll printing system 100 according to an embodiment of the present invention is configured to adopt a method of controlling a tension of the flexible substrate 10 based on torque values of the nip roll driving motors 142B and the nip roll unit driving motors 148A instead of using a load cell or a dancer. Thus, when the flexible substrate 10 is fed, the fluid spread onto the flexible substrate 10 does not flow down. The method of controlling the tension of the flexible substrate 10 based on the torque values of the nip roll driving motors 142B and the nip roll unit driving motors 148A is described in detail later with reference to FIG. 6.

The roll-to-roll printing system 100 according to an embodiment of the present invention, as shown in FIG. 1, further includes a baking device 180 for baking the process layers 10*a* and 10*b* of the flexible substrate 10. The baking device 180 is disposed at a position upstream of the second EPC sensor 150B. The roll-to-roll printing system 100 according to an embodiment of the present invention, as shown in FIG. 1 and FIG. 4, further includes a first air lifting device 170A between the first driven roll 130A and the second driven roll 130B and a second air lifting device 170B between the second driven roll 130B and the third driven roll 130C. Since there are large gaps between the driven rolls 130A, 130B and 130C, the flexible substrate 10 may be bent down or sag in the regions between the driven rolls 130A, 130B and 130C. The air lifting devices 170A and 170B provided between the driven rolls 130A, 130B and 130C uniformly lift the flexible substrate 10, thereby preventing the flexible substrate 10 from being bent down or sagging. As shown in FIG. 5, the first air lifting device 170A includes a box-shaped casing 172A having a plurality of holes 174A formed throughout an upper surface of the box-shaped casing 172A and an air supply tube 176A connected to a lateral surface of the casing 172A. Air is supplied into the casing 172A through the air supply tube 176A, and then is discharged through the plurality of holes 174A via paths formed in the casing 172A. The air discharged from the air lifting device 170A generates pneumatic pressure and lifts the flexible substrate 10.

Figure 6:
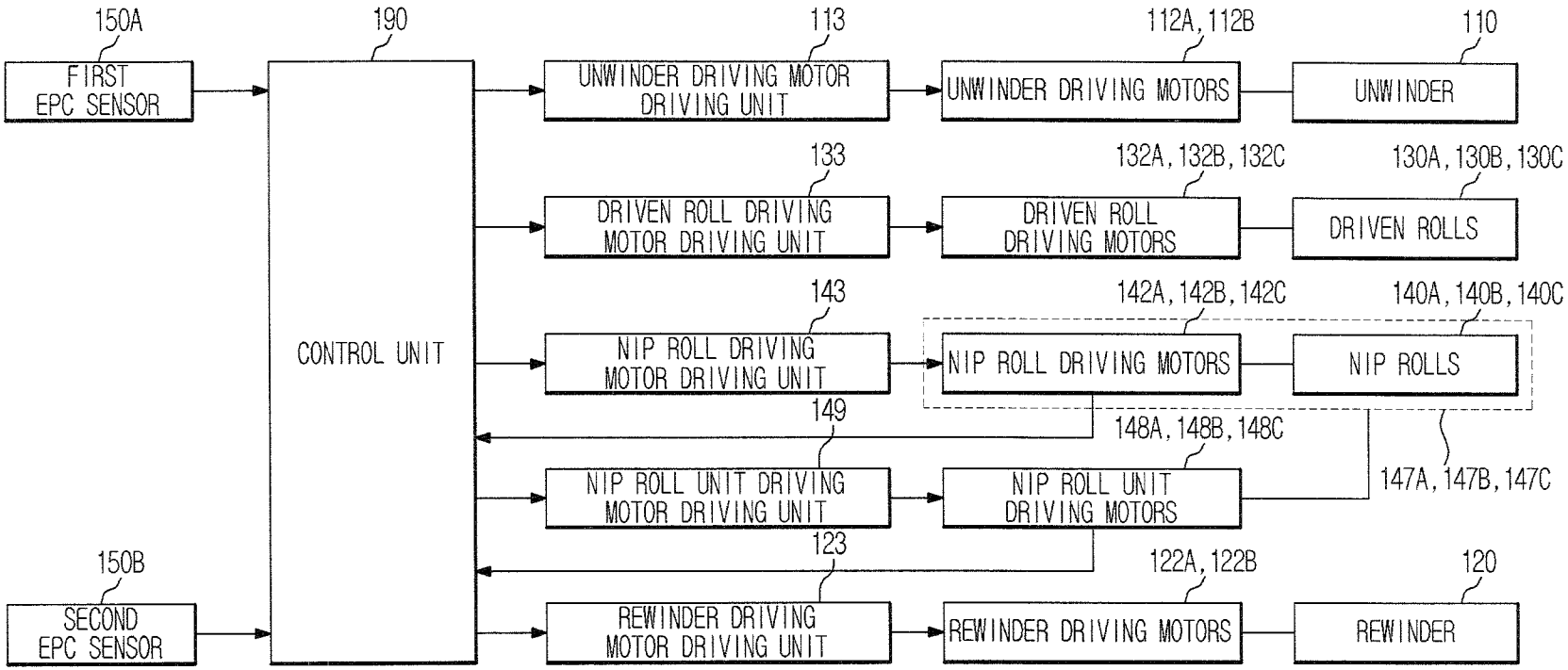
FIG. 6 is a control block diagram of a roll-to-roll printing system according to an embodiment of the present invention.

FIG. 6 is a control block diagram of a roll-to-roll printing system according to an embodiment of the present invention.

As shown in FIG. 6, the roll-to-roll printing system 100 according to an embodiment of the present invention includes first and second EPC sensors 150A and 150B, a control unit 190, unwinder driving motors 112A and 112B, driven roll driving motors 132A, 132B and 132C, nip roll driving motors 142A, 142B and 142C, nip roll unit driving motors 148A, 148B and 148C, rewinder driving motors 122A and 122B, and motor driving units 113, 133, 143, 149 and 123 to drive the driving motors 112A and 112B, 132A, 132B, and 132C, 142A, 142B, and 142C, 148A, 148B, and 148C, 122A and 122B, and 113, 133, 143, 149, and 123.

The first and second EPC sensors 150A and 150B detect positions of two opposite edges of the flexible substrate 10 during feeding of the substrate and output detected signals to the control unit 190.

According to an embodiment, the control unit 190 is configured as a microcontroller which controls the overall operation of the roll-to-roll printing system 100. The control unit 190 transmits control signals to the motor driving units 113, 123, 133, 143 and 149 and controls the operation of the driving motors 112A, 112B, 122A, 122B, 132A, 132B, 132C, 142A, 142B, 142C, 148A, 148B and 148C, thereby controlling unwinding, feeding and rewinding operations performed upon the flexible substrate 10.

When the roll-to-roll printing system 100 starts a continuous operation including feeding, processing, printing and storage processes upon the flexible substrate 10, the control unit 190 transmits a control signal to the unwinder driving motor driving unit 113 and activates the unwinder driving motors 112A and 112B. Accordingly, the flexible substrate 10 is unwound from the unwinder 110 and fed to a region for the printing process.

Using the position signals of the two opposite edges of the flexible substrate 10 detected by the first and second EPC sensors 150A and 150B, the control unit 190 moves the unwinder 110 and the rewinder 120 in a cross machine direction (CMD, a cross direction with respect to a feeding direction of the flexible substrate 10). Accordingly, the flexible substrate 10 can be fed while being kept in a correct position in a transverse direction of the flexible substrate 10.

When the feeding of the flexible substrate 10 starts, the control unit 190 transmits control signals to the driven roll driving motor driving unit 133 and the nip roll driving motor driving unit 143 and activates the driven roll driving motors 132A, 132B and 132C and the nip roll driving motors 142A, 142B and 142C, thereby feeding the flexible substrate 10. Since an operation of the driven roll driving motors 132A, 132B and 132C is synchronized with an operation of the nip roll driving motors 142A, 142B and 142C, the driven rolls 130A, 130B and 130C and the nip rolls 140A, 140B and 140C rotate cooperatively with each other, thereby applying a feeding force to the flexible substrate 10 interposed therebetween and feeding the same.

While the flexible substrate 10 is fed by an operation of the driven roll driving motors 132A, 132B and 132C and the nip roll driving motors 142A, 142B and 142C, the control unit 190 controls the tension of the flexible substrate 10 in a machine direction (MD, a feeding direction of the flexible substrate 10) using feedback signals from the nip roll driving motors 142A, 142B and 142C. In detail, the control unit 190 receives the feedback signals from the nip roll driving motors 142A, 142B and 142C, and calculates torque values of the nip roll driving motors 142A, 142B and 142C using the feedback signals. Subsequently, based on the calculated torque values of the nip roll driving motors 142A, 142B and 142C, the control unit 190 controls rates of rotation of the driven roll driving motors 132A, 132E and 132C and the nip roll driving motors 142A, 142B and 142C, thereby controlling the tension of the flexible substrate 10 in the machine direction.

According to an embodiment, while the flexible substrate 10 is fed, the control unit 190 controls the tension of the flexible substrate 10 in the cross machine direction using feedback signals from the nip roll unit driving motors 148A, 148B and 148C. In detail, the control unit 190 receives the feedback signals from the nip roll unit driving motors 148A, 148B and 148C, and calculates torque values of the nip roll unit driving motors 148A, 148B and 148C using the feedback signals. Subsequently, based on the calculated torque values of the nip roll unit driving motors 148A, 148B and 148C, the control unit 190 controls rotation directions and rotation angles of the nip roll unit driving motors 148A, 148B and 148C (as a result, spin directions and spin angles of the nip rolls 140A, 140B and 140C are controlled), thereby controlling the tension of the flexible substrate 10 in the cross machine direction.

According to an embodiment, while the flexible substrate 10 is fed, the control unit 190 transmits control signals to the rewinder driving motor driving unit 123 and activates the rewinder driving motors 122A and 122B, thereby performing an operation of rewinding the flexible substrate 10 having undergone the printing and baking processes around the rewinder 120.

According to an embodiment, the control unit 190 includes an internal memory (not shown) to store a target tension to be achieved when controlling the tension of the flexible substrate 10 and target pressurizing force to be achieved when nipping the flexible substrate 10.

According to an embodiment of the present invention, information necessary to control the tension of the flexible substrate 10 and nip the flexible substrate 10 is previously stored in the internal memory of the control unit 190. However, alternatively, an additional storage unit is provided to previously store information necessary to control the tension of the flexible substrate 10 and nip the flexible substrate 10.

The unwinder driving motor driving unit 113 sets torque input values of the motors according to the control signals from the control unit 190, and drives the unwinder driving motors 112A and 112B.

The unwinder driving motors 112A and 112B are respectively connected to both ends of the unwinder 110 one by one, and receive the torque input values of the unwinder driving motor driving unit 113 to rotate the unwinder 110.

The driven roll driving motor driving unit 133 sets torque input values of the motors according to the control signals from the control unit 190 and drives the driven roll driving motors 132A, 132B and 132C.

The driven roll driving motors 132A, 132B and 132C are respectively connected to two opposite ends of the driven rolls 130A, 130B and 130C, and receive the torque input values of the driven roll driving motor driving unit 133 and rotate the driven rolls 130A, 130B and 130C.

The nip roll driving motor driving unit 143 sets torque input values of the motors according to the control signals from the control unit 190 and drives the nip roll driving motors 142A, 142B and 142C.

The nip roll driving motors 142A, 142B and 142C are respectively connected to one end of the nip rolls 140A, 140B and 140C, and receive the torque input values of the nip roll driving motor driving unit 143 and rotate the nip rolls 140A, 140B and 140C.

The nip roll unit driving motor driving unit 149 sets torque input values of the motors according to the control signals from the control unit 190, and drives the nip roll unit driving motors 148A, 148B and 148C.

The nip roll unit driving motors 148A, 148B and 148C are respectively connected to the nip roll units 147A, 147B and 147C, which respectively include the nip rolls 140A, 140B and 140C, the nip roll driving motors 142A, 142B and 142C, the pressurizing cylinders 144B (see FIG. 3) and the pressure sensors 146B (see FIG. 3). The nip roll unit driving motors 148A, 148B and 148C receive the torque input values of the nip roll driving motor driving unit 143 and spin the nip roll units 147A, 147B and 147C.

The rewinder driving motor driving unit 123 sets torque input values of the motors according to the control signals from the control unit 190 and drives the rewinder driving motors 122A and 122B.

The rewinder driving motors 122A and 122B are respectively connected to two opposite ends of the rewinder 120, and receive the torque input values of the rewinder driving motor driving unit 123 and rotate the rewinder 120.

Hereinafter, an operation of the roll-to-roll printing system according to an embodiment of the present invention is described with reference to FIGS. 1 through 6.

When a user inputs an operating command to the roll-to-roll printing system 100 using an input unit (not shown), the roll-to-roll printing system 100 starts to operate.

The control unit 190 activates the unwinder driving motors 112A and 112B, so that the flexible substrate 10 is unwound from the unwinder 110 and fed to a region for a printing process.

The control unit 190 moves the unwinder 110 in the cross machine direction using the position signals of two opposite edges of the flexible substrate 10 detected by the first EPC sensor 150A. Accordingly, the flexible substrate 10 can be fed while being kept in a correct position.

After the flexible substrate 10 is unwound from the unwinder 110, the printing process of spreading the fluid having a certain viscosity (e.g., liquid crystal) onto the flexible substrate 10 using the dispenser 160 is performed.

Then, the nip rolls 140A, 140B and 140C pressurize two opposite side margins (on which the fluid is not spread) of the flexible substrate 10. To prevent the process layers 10*a* and 10*b* of the flexible substrate 10 from being damaged, the nip rolls 140A, 140B and 140C do not pressurize the process layers 10*a* and 10*b*.

Since an operation of the driven roll driving motors 132A, 132B and 132C is synchronized with an operation of the nip roll driving motors 142A, 142B and 142C, the driven rolls 130A, 130B and 130C and the nip rolls 140A, 140B and 140C rotate cooperatively with each other, thereby applying a feeding force to the flexible substrate 10 interposed therebetween and feeding the same.

While the flexible substrate 10 is fed, the control unit 190 controls the tension of the flexible substrate 10 in the machine direction using the torque values of the nip roll driving motors 142A, 142B and 142C. When the torque values of the nip roll driving motors 142A, 142E and 142C increase, the control unit 190 determines that the tension of the flexible substrate 10 increases. Accordingly, the control unit 190 increases the speeds of the driven roll driving motors 132A, 132B and 132C so that the flexible substrate 10 is fed more rapidly, thereby controlling the tension of the flexible substrate 10 in the machine direction. The speeds of the nip roll driving motors 142A, 142B and 142C are also changed (e.g., increased) according to a change of the speeds of the driven roll driving motors 132A, 132B and 132C.

When the torque values of the nip roll driving motors 142A, 142B and 142C decrease, the control unit 190 determines that the tension of the flexible substrate 10 decreases. Accordingly, the control unit 190 decreases the speeds of the driven roll driving motors 132A, 132B and 132C so that the flexible substrate 10 is fed more slowly, thereby controlling the tension of the flexible substrate 10 in the machine direction. The speeds of the nip roll driving motors 142A, 142B and 142C are also changed (e.g., decreased) according to a change of the speeds of the driven roll driving motors 132A, 132B and 132C.

According to an embodiment, while the flexible substrate 10 is fed, the control unit 190 controls the tension of the flexible substrate 10 in the cross machine direction based on the torque values of the nip roll unit driving motors 148A, 148B and 148C. When the torque values of the nip roll unit driving motors 148A, 148B and 148C increase, the control unit 190 determines that the tension of the flexible substrate 10 increases. Accordingly, the control unit 190 controls the nip roll unit driving motors 148A, 148B and 148C so that the nip rolls 140A, 140B and 140C nipping two opposite side margins of the flexible substrate 10 spin in a converging direction, for example, an inward direction of the flexible substrate 10 (refer to a spin direction of the third nip rolls 140C in FIG. 4), thereby controlling the tension of the flexible substrate 10 in the cross machine direction. The rotation angles of the nip roll unit driving motors 148A, 148B and 148C as well as the rotation directions of the nip roll unit driving motors 148A, 148B, and 148C are controlled together in proportion to a change of the torque values of the nip roll unit driving motors 148A, 148B and 148C.

When the torque values of the nip roll unit driving motors 148A, 148B and 148C decrease, the control unit 190 determines that the tension of the flexible substrate 10 decreases. Accordingly, the control unit 190 controls the nip roll unit driving motors 148A, 148B and 148C so that the nip rolls 140A, 140B and 140C nipping two opposite side margins of the flexible substrate 10 spin in a diverging direction, for example, an outward direction of the flexible substrate 10 (refer to a spin direction of the second nip rolls 140B in FIG. 4), thereby controlling the tension of the flexible substrate 10 in the cross machine direction. The rotation angles of the nip roll unit driving motors 148A, 148B and 148C as well as the rotation directions of the nip roll unit driving motors 148A, 148B, and 148C are controlled together in proportion to a change of the torque values of the nip roll unit driving motors 148A, 148B and 148C.

According to an embodiment, the nip rolls 140B are made of an elastic material, such as urethane or polydimethylsiloxane (PDMS), or a material that generating a large frictional force with respect to the flexible substrate 10, so that a gripping force of the nip rolls 140A, 140B and 1400 applied to the flexible substrate 10 can be increased, thereby more accurately controlling the tension of the flexible substrate 10 (more accurately detecting a change of the tension of the flexible substrate 10) based on the torque values of the nip roll driving motors 142A, 142B and 142C and the nip roll unit driving motors 148A, 148B and 148C.

According to an embodiment, to prevent the flexible substrate 10 from being bent down or sagging in the regions between the driven rolls 130A, 130B and 130C while being fed, the air lifting devices 170A and 170E lift the flexible substrate 10 by uniform air pressure.

After the printing process, the flexible substrate 10 undergoes a baking process using the baking device 180. The control unit 190 activates the rewinder driving motors 122A and 122B to rewind the flexible substrate 10 around the rewinder 120 after the printing process and the baking process are completed.

Figure 7:
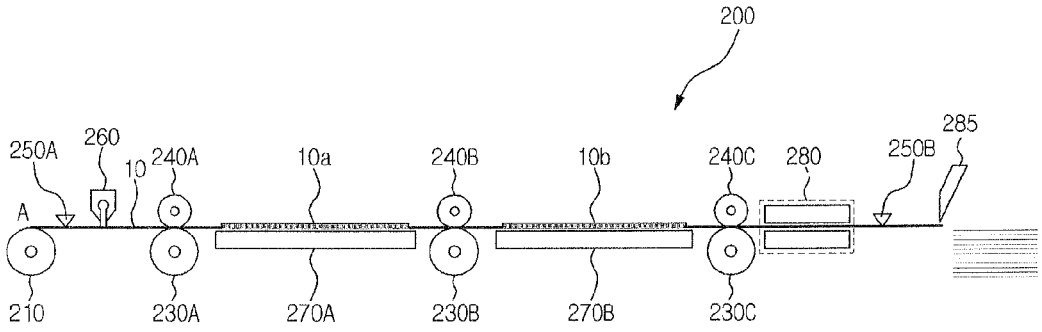
FIG. 7 is a view showing a configuration of a roll-to-sheet printing system according to an embodiment of the present invention.

FIG. 7 is a view showing a roll-to-sheet printing system according to an embodiment of the present invention.

As shown in FIG. 7, a roll-to-sheet printing system 200 according to an embodiment of the present invention is different from the roll-to-roll printing system 100 depicted in FIG. 1, in that a flexible substrate 10 having undergone printing and baking processes is cut to a certain size by a cutting device 285 instead of being rewound around a rewinder 120. According to an embodiment, the roll-to-sheet printing system 200 is used when the flexible substrate 10 cannot be rewound, for example, for the reason that the process layers 10*a* and 10*b* are cracked when the flexible substrate 10 having undergone the printing and baking processes is rewound around the rewinder 120.

Other structural components than the cutting device 285 in the roll-to-sheet printing system 200 according to an embodiment of the present invention depicted in FIG. 7 are the same as those in the roll-to-roll printing system 100 depicted in FIG. 1.

Although a few embodiments of the present invention have been shown and described, it would be appreciated by those skilled in the art that changes may be made in these embodiments.

What is claimed is:

1. A roll-to-roll printing system comprising:

driven rolls configured to apply a feeding force to a flexible substrate so that the flexible substrate is fed from an unwinder to a rewinder;

nip rolls respectively disposed above two opposite end portions of each of the driven rolls, the nip rolls configured to pressurize two opposite side portions of the flexible substrate;

nip roll driving motors connected to the nip rolls, the nip roll driving motors configured to rotate the nip rolls;

a control unit configured to receive information regarding a change of torque values of the nip roll driving motors and to control tension of the flexible substrate based on the information;

nip roll units including the nip rolls and pressurizing cylinders, the pressurizing cylinders configured to pressurize the nip rolls; and nip roll unit driving motors connected to the nip roll units, the nip roll unit driving motors configured to spin the nip roll units, wherein the control unit is configured to control the tension of the flexible substrate in a cross machine direction based on information regarding a change of torque values of the nip roll unit driving motors.

2. The roll-to-roll printing system according to claim 1, further comprising:

driven roll driving motors connected to the driven rolls, the driven roll driving motors configured to rotate the driven rolls.

3. The roll-to-roll printing system according to claim 2, wherein the control unit is configured to enable an operation of the driven roll driving motors to be synchronized with an operation of the nip roll driving motors.

4. The roll-to-roll printing system according to claim 2, wherein when the torque values of the nip roll driving motors increase, the control unit is configured to enable speeds of the driven roll driving motors and the nip roll driving motors to increase.

5. The roll-to-roll printing system according to claim 2, wherein when the torque values of the nip roll driving motors decrease, the control unit is configured to enable speeds of the driven roll driving motors and the nip roll driving motors to decrease.

6. The roll-to-roll printing system according to claim 1, wherein the control unit is configured to control the tension of the flexible substrate in a cross machine direction based on the information.

7. The roll-to-roll printing system according to claim 1, wherein when torque values of the nip roll unit driving motors increase, the control unit controls the nip roll unit driving motors so that the nip rolls spin in an inward direction of the flexible substrate.

8. The roll-to-roll printing system according to claim 1, wherein when torque values of the nip roll unit driving motors decrease, the control unit controls the nip roll unit driving motors so that the nip rolls spin in an outward direction of the flexible substrate.

9. The roll-to-roll printing system according to claim 1, further comprising:

a dispenser configured to perform a printing process by spreading a fluid onto the flexible substrate.

10. The roll-to-roll printing system according to claim 1, further comprising:

air lifting devices configured to lift the flexible substrate by applying air pressure to the flexible substrate.

11. The roll-to-roll printing system according to claim 1, wherein the nip rolls are made of urethane or polydimethylsiloxane.

12. A printing system comprising:

a nip roll;

a driven roll rotating while engaged with the nip roll, with a substrate between the nip roll and the driven roll;

a first driving motor rotating the nip roll so that the substrate is moved in a first direction;

a second driving motor rotating the nip roll so that the nip roll is oriented toward a second direction different from the first direction;

a controller configured to receive a first feedback signal from the first driving motor, to yield a first torque value according to the first feedback signal, and to control a rotating speed of the first motor based on the first torque value, wherein the controller is configured to receive a second feedback signal from the second driving motor, to yield a second torque value according to the second feedback signal, and to control a rotating direction and a rotating angle of the second motor based on the second torque value to rotate the nip roll in the second direction.

13. The printing system of claim 12, further comprising:

an unwinder at a position upstream of the nip roll, wherein the unwinder is configured to unwind the substrate.

14. The printing system of claim 13, further comprising:

one of a rewinder or a cutting device at a position downstream of the nip roll, wherein the rewinder is configured to rewind the substrate, and the cutting device is configured to cut the substrate to a predetermined size.

15. The printing system of claim 14, wherein the first direction is a feeding direction of the substrate from the unwinder to one of the rewinder or the cutting device, and the second direction is an inward or outward direction of the substrate.

16. The printing system of claim 12, wherein a fluid is spread on a top surface of the substrate except for where the nip roll is placed.

17. The printing system of claim 12, wherein a rotation of the driven roll is dependent on a rotation of the nip roll.

* * * * *